US005771878A

United States Patent [19]

Lewis et al.

[11] Patent Number: 5,771,878

[45] Date of Patent: Jun. 30, 1998

[54] SAFETY KNOB

[76] Inventors: Luke E. Lewis; Christopher E. Lewis, both of 312 Arbor Vista Blvd., Jackson, Miss. 39209

[21] Appl. No.: 734,101

[22] Filed: Oct. 21, 1996

Related U.S. Application Data

[63] Continuation-in-part of Ser. No. 44,508, Sep. 25, 1995, Pat. No. Des. 378,045.

[60] Provisional application No. 60/001,566 Jul. 21, 1995.

[51] Int. Cl.[6] ..... F24C 3/08

[52] U.S. Cl. ..... 126/42; 431/153; 137/385; 251/96

[58] Field of Search ..... 126/42; 431/153; 137/385; 251/96

[56] References Cited

U.S. PATENT DOCUMENTS 703,564 7/1902 Ellison .
1,412,720 4/1922 Szafranski .
1,621,876 3/1927 Doerr .
2,039,011 4/1936 Leonard .
2,214,730 9/1940 Jeffers ..... 126/42
2,525,562 10/1950 Reeves .
2,849,891 9/1958 Mills ..... 126/42
3,035,567 5/1962 Reeves .
3,200,807 8/1965 Culligan .
3,764,103 10/1973 Oliverio .
4,300,525 11/1981 Delgado et al. .

*Primary Examiner*—Carroll B. Dority
*Attorney, Agent, or Firm*—Burd, Bartz & Gutenkauf

[57] ABSTRACT

A knob for a stove or range that has a releasable lock assembly which prevents a switch or valve of the range from being turned ON. The lock assembly has a pin movable between a lock position and a release position with a linear to rotational movement mechanism mounted in a housing joined to the body of the knob.

12 Claims, 3 Drawing Sheets

SAFETY KNOB

CROSS REFERENCE TO RELATED APPLICATION

This application is a continuation-in-part of U.S. application Ser. No. 29/044,508 filed Sep. 25, 1995 and now patent No. B378045. This application claims the benefit of U.S. provisional application No. 06/001,566 Jul. 21, 1995.

FIELD OF THE INVENTION

The invention is in the field of switch and valve control devices that prevent inadvertent or accidental operation of the devices. More particularly, a knob mounted on the actuator of the control device has a releasable lock assembly that has a lock position preventing operation of the control device and a release position allowing operation of the control device.

BACKGROUND OF THE INVENTION

Kitchen gas and electric stoves and ovens have switches and valve devices for controlling the flow of electric power and gas to burners. These devices have spring-biased actuators which are shafts that must first be pushed in to the stoves before they can be rotated to activate the devices. Knobs are mounted on the shafts to provide convenient manual pushing and turning of the shafts. The push and turn feature of the switch and valve device is a safety lock to insure against the inadvertent or accidental turning ON of the stove or oven burners. An example of a control knob and stop for a push and turn operation of a gas valve is shown by J. D. Delgado and G. Spector in U.S. Pat. No. 4,300,525. Conventional gas and electric ranges have push and turn regulators for controlling the operation of the burners. Knobs adjacent the front panel or top plate of the ranges connected to the regulators are manually operated to turn the regulators ON and OFF and control the operation of the burners. Children are attracted to the knobs and try to turn and sometimes remove the knobs from the ranges. They can also push and turn the knobs, thereby turning the burners ON. The safety knob of the invention overcomes the disadvantages of the conventional push and turn control device and increase the safety to children that play with range control knobs.

SUMMARY OF THE INVENTION

The invention resides in a knob for a central device having an actuator that is linearly moved between lock and release positions and rotatable when in the release position to activate the control device, such as electrical switches, fluid control valves and regulators. The knob has a body adapted to be mounted on the actuator which is used to push and turn the actuator. A releasable lock assembly is mounted on the body and operates to selectively lock the knob in a position so that it cannot be pushed, thereby preventing the actuator from being pushed and allowing turning of the actuator and an unlocking of the knob so that it can be used to push and turn the actuator. The releasable lock assembly prevents inadvertent and accidental operation of the control device. The releasable lock assembly on the knob is a deterrent for children to turn the control device ON.

The releasable lock assembly has a housing joined to the body of the knob. A pin movably mounted in the housing is extendible to a lock position and retractable to a release position. A sleeve movable between two positions by linear movement of a push rod engages the pin and holds the pin in its lock position. The sleeve is angularly moved or stopped with a linearly-movable head having a number of teeth that ratchet with cooperating teeth on the sleeve. A button on the outer end of the push rod provide a convenient surface upon which manual pressure can be applied to the push rod. In use, one push on the button will lock the pin against a support or in a hole in the support. A second push on the button will release the pin so that the actuator can be pushed and then turned to activate the control device. The knob and releasable lock assembly has been described as used with an actuator of a control device for a cooking range or stove. The knob with the releasable lock assembly is usable with other apparatus and machines that have control devices with push and turn actuators.

DESCRIPTION OF THE PREFERRED EMBODIMENT

Referring to FIGS. 1–6, there is shown the knob of the invention indicated generally at 10, for a control device 23 such as a switch or valve found on an appliance, including but not limited to electric stove and ovens, and gas ovens and heaters. Knob 10 has a releasable lock assembly, indicated generally at 28, having a lock position which prevents the operation of the control device and a release position allowing the control device to be actuated with knob 10.

Figure 1:
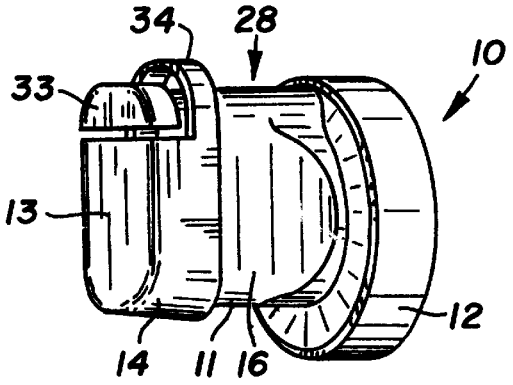
FIG. 1 is a perspective view of a knob of the invention for manually operating a control device for a stove.
Figure 2:
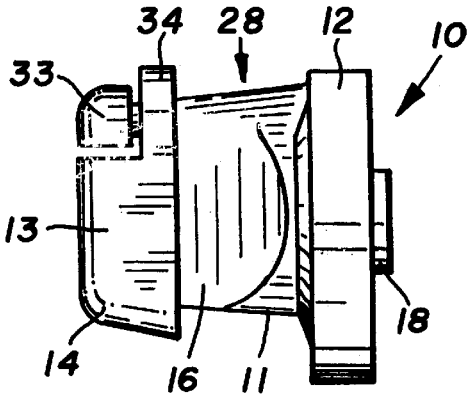
FIG. 2 is a side view of the knob.
Figure 3:
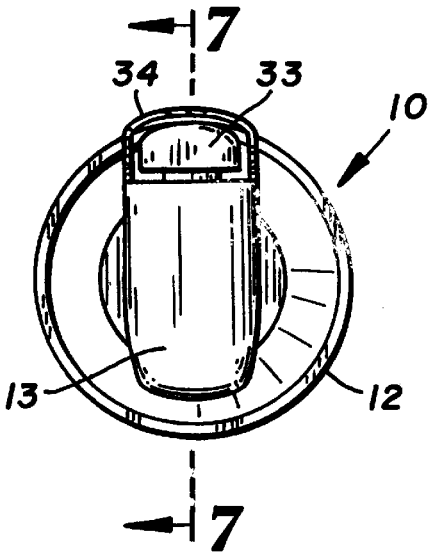
FIG. 3 is a front elevational view of the knob.
Figure 4:
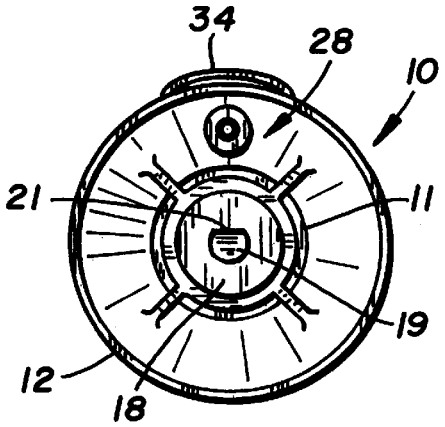
FIG. 4 is a rear elevational view of the knob.
Figure 5:
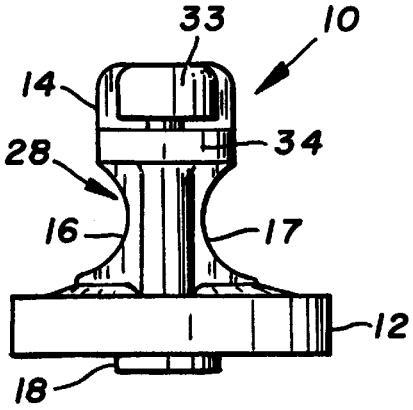
FIG. 5 is a top plan view of the knob.
Figure 6:
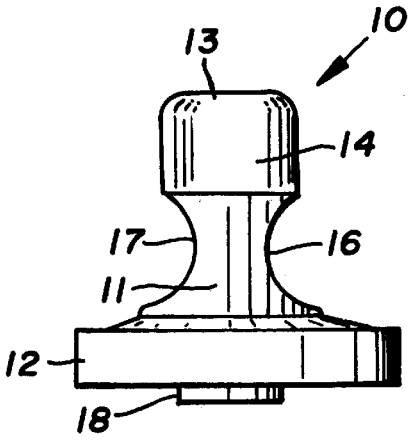
FIG. 6 is a bottom plan view of the knob.
Figure 7:
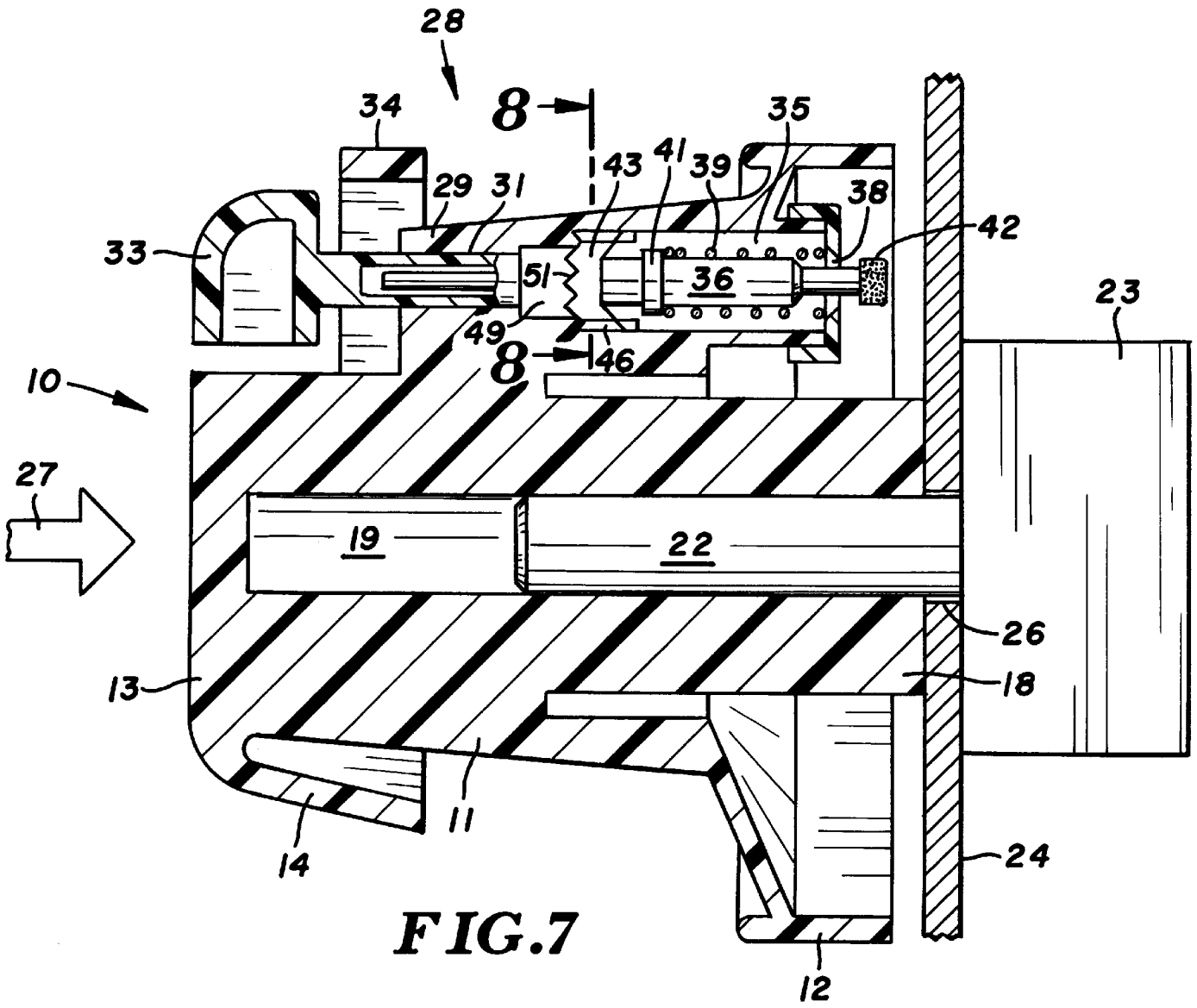
FIG. 7 is an enlarged sectional view taken along the line 7—7 of FIG. 3 showing the knob operatively associated with a control device with the lock pin in the retracted position.
Figure 8:
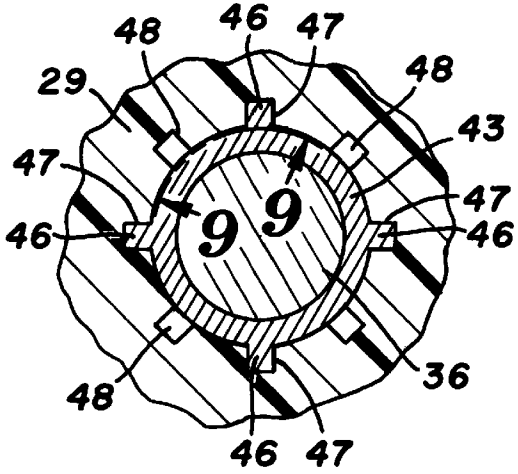
FIG. 8 is an enlarged sectional view taken along the line 8—8 of FIG. 7.

Knob 10 has a body 11 joined to a cylindrical rim 12. The outer end of body 11 has an elongated oval-shaped head 13 having a downwardly-extended peripheral flange 14. As seen in FIGS. 5 and 6, body 11 has concave-shaped side walls 16 and 17 to facilitate the gripping of the body with the fingers of a hand, and the turning of the knob to activate the control device 23. Body 11, as seen in FIGS. 4, 5 and 6, has an inner cylindrical end 18 having a longitudinal non-circular blind bore 19. Body 11 has a flat side 21 facing bore 19 to accommodate a control shaft 22 of control device 23, as seen in FIGS. 7 and 8.

Control device 23 is mounted on a support 24, such as the face plate of a kitchen range or stove. Plate 24 has a hole 26 that accommodates shaft 22. Knob 10 is moved linearly in the direction of the arrow 27 to actuate control device 23. When control device 23 is actuated or released, knob 10 can be turned to effect a switching operation or opening of a valve to allow energy to flow to a burner of the stove. Control device 23 can be connected to other machines and appliances for controlling electrical or fluid functions of the machines and appliances.

Figure 10:
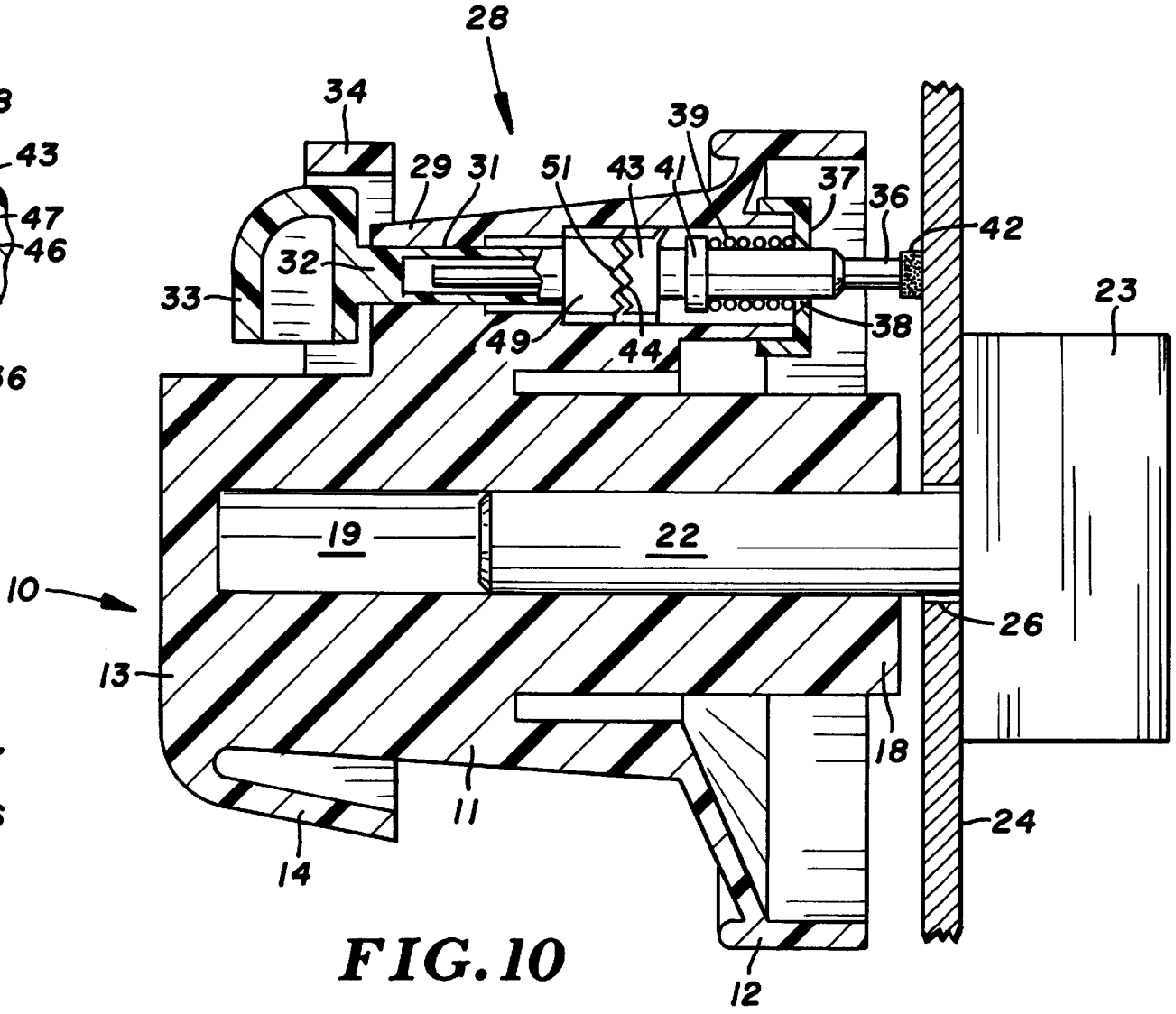
FIG. 10 is a sectional view similar to FIG. 7, showing the lock pin in the extended position.

Releasable lock assembly 28 has a housing 29 joined with one side of body 11. Housing 29 has a longitudinal bore 31 accommodating a push rod 32. The outer end of push rod 32 has a button 33 used to manually actuate the lock assembly to both the lock and unlock positions. A generally U-shaped band or guard 34 extends about button 33 and is joined to opposite sides of flange 14 to prevent inadvertent movement of button 33 which could release the lock assembly. Housing 29 has a cylindrical chamber 35 axially aligned with and open to base 31. A pin 36, located in chamber 35, extends through a hole 38 in a cap 37 mounted on the inner end of housing 29. A coil spring 39 surrounding pin 36 biases pin 36 to its release position, as shown in FIG. 7. One end of spring 39 engages cap 37. The opposite end of spring 39 contacts an annular collar 41 joined to the middle section of pin 36, spring 39 biases pin 36 and push rod 32 to the out or release position. A flexible member or shoe 42 is mounted on the outer end of pin 36 to protect the surface of plate 24, as shown in FIG. 10. When lock assembly 28 is in the lock position, shoe 42 engages plate 24 and prevents knob 10 from being pushed in to a position wherein control device 23 can be turned ON. The outer end of pin 36 can project into a hole (not shown) on plate 24 to prevent turning of knob 10. Pin 36 must be retracted from the hole before knob 10 can be turned to activate control device 23.

Figure 9:
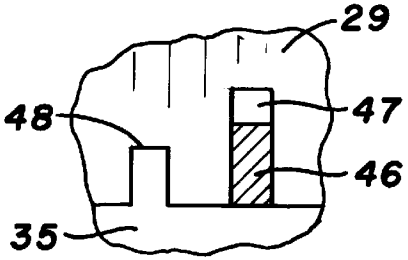
FIG. 9 is an enlarged sectional view taken along the curved line 9—9 of FIG. 8.

The inner end of pin 36 fits into a cup-shaped sleeve 43 having one way inclined teeth 44 on the inner circular end thereof. As shown in FIG. 8, sleeve 43 has four outwardly-projected ribs 46 circumferentially located around the outside of sleeve 43. Ribs 46 are located in longitudinal grooves 47 when pin 36 is in the release position, as shown in FIG. 7. When sleeve 43 is turned about 45 degrees, ribs 46 are located in grooves 48. As seen in FIG. 9, grooves 48 are shorter than grooves 47 so that ribs 46 engage the bases of groove 48 to hold pin 36 in the lock position, as shown in FIG. 10. The ribs and grooves can extend at an angle relative to the longitudinal axis of sleeve 43 to establish circumferential movement of sleeve 43.

Sleeve 43 is sequentially turned in response to linear movement of a head 49 on the inner end of push rod 32. Head 49 fits into the bore of rod 32 to facilitate assembly of head 49 on push rod 32. Head 49 has teeth 51 and aligned teeth 44 on sleeve 43. When button 33 is pushed in, teeth 51 rachet sleeve 43 in a circumferential direction to move ribs 46 into the next groove to release lock pin 36 or lock the pin 36 relative to knob 10.

The releasable lock assembly 28 is one form of a linear rotational motion transfer mechanism and holding device to prevent knob 10 from actuating control device 23. Other releasable structures can be used to hold pin 36 in a fixed position and alternatively allow pin 36 to move so that knob 10 can actuate control device 23.

In use, knob 10 is mounted on shaft 22 placing shaft 22 in blind non-circular base 19 with the body 18 adjacent range support 24. When button 33 is pushed in, as shown in FIG. 10, pin 36 is in the extended lock position and bears against support 24. The pin 36 prevents knob 10 from pushing shaft 22 in to a position when shaft 22 can be turned to activate control device 23. Sleeve 43 holds pin 36 in the locked position when ribs 46 are in short grooves 48 in housing 29. When button 33 is pushed for a second time, sleeve 43 is rotated to a position where ribs 46 are in long grooves 47, as shown in FIGS. 7–9. This allows spring 39 to retract pin 36 to the release position. Knob 10 and shaft 22 can then be pushed in and turned to activate control device 23.

While there has been shown and described a knob with a releasable lock assembly for a kitchen range, it is understood that changes in the knob design and structure of the knob and releasable lock assembly can be made by one skilled in the art without departing from the invention. The invention is defined in the following claims.

We claim:

1. A knob for a control device mounted on a support, the control device having a shaft which is linearly moved between lock and release positions and rotatable when in the release position to actuate the control device comprising: a body adapted to be mounted on the shaft and used to linearly move the shaft between lock and release positions and rotate the shaft when it is in the release position to actuate the control device, and a releasable holding assembly secured to the body for selectively retaining the body in the first position and allowing the body to be moved to the second position, the releasable holding assembly has a pin movable to a first position to engage the support to retain the body in the first position and movable from the first position to a second position wherein the pin is spaced from the support, means operatively connected to the pin to selectively move the pin to its first position and second position, the means operatively connected to the pin includes a holding member movable between first and second longitudinal positions to retain the pin in its first and second positions, and button means for moving the holding member between its first and second positions.

2. The knob of claim 1 wherein: the body has a bore for accommodating the shaft of the control device.

3. The knob of claim 1 including: a head secured to the body, a flange surrounding the body secured to the head, and band means secured to the flange for guarding against the button means.

4. A knob for a control device mounted on a support, the control device having a shaft which is linearly moved between lock and release positions and rotatable when in the release position to actuate the control device comprising: a body adapted to be mounted on the shaft and used to linearly move the shaft between lock and release positions and rotate the shaft when it is in the release position to actuate the control device, a releasable holding assembly mounted on to the body for selectively retaining the body in the first position and allowing the body to be moved to the second position, the releasable holding assembly has a pin movable to a first position to engage the support to retain the body in the first position and movable from the first position to a second position wherein the pin is spaced from the support, means operatively connected to the pin to selectively move the pin to its first position and second position, the means operatively connected to the pin includes a holding member movable between first and second longitudinal positions to retain the pin in its first and second positions, and button means for moving the holding member between its first and second positions.

5. A knob for a control device mounted on a support, the control device having a shaft which is linearly moved between lock and release positions and rotatable when in the release position to actuate the control device comprising: a body adapted to be mounted on the shaft and used to linearly move the shaft between lock and release positions and rotate the shaft when it is in the release position to actuate the control device, and a releasable holding assembly secured to the body for selectively retaining the body in the first position and allowing the body to be moved to the second position, the releasable holding device includes a housing joined to the body, a pin engageable with the support to prevent the knob from being moved toward the support, a sleeve mounted on the housing engageable with the pin to selectively hold the pin in engagement with the support and release the pin from the support, spring means for biasing the pin away from the support, and means for linearly and angularly moving the sleeve to a first position wherein the sleeve holds the pin in engagement with the support and a second position wherein the sleeve is released from the support.

6. A knob for a kitchen range having a control device mounted on a support, the control device having a shaft extended through a hole in the support which is linearly moved between lock and release positions and rotatable when in the release position to actuate the control device to turn ON a burner of the range comprising: a body adapted to be mounted on the shaft and used to linearly move the shaft adjacent the support opposite the control device between lock and release positions and rotate the shaft when it is in the release position to actuate the control device, and a releasable holding assembly secured to the body and cooperating with the support for selectively retaining the body in the first position to prevent operation of the control device and allowing the body to be moved to the second position whereby the control device can be actuated by pushing and turning the shaft, the releasable holding assembly has a pin movable to a first position to engage the support to retain the body in the first position and movable from the first position to a second position wherein the pin is spaced from the support, means operatively connected to the pin to selectively move the pin to its first position and second position, the means operatively connected to the pin includes a holding member movable between first and second longitudinal positions to retain the pin in its first and second positions, and button means for moving the holding member between its first and second positions.

7. The knob of claim 6 wherein: the body has a bore for accommodating the shaft of the control device.

8. The knob of claim 6 including: a head secured to the body, a flange surrounding the body secured to the head, and band means secured to the flange for guarding against the button means.

9. A knob for a kitchen range having a control device mounted on a support, the control device having a shaft extended through a hole in the support which is linearly moved between lock and release positions and rotatable when in the release position to actuate the control device to turn ON a burner of the range comprising: a body adapted to be mounted on the shaft and used to linearly move the shaft adjacent the support opposite the control device between lock and release positions and rotate the shaft when it is in the release position to actuate the control device, and a releasable holding assembly secured to the body and cooperating with the support for selectively retaining the body in the first position to prevent operation of the control device and allowing the body to be moved to the second position whereby the control device can be actuated by pushing and turning the shaft, the releasable holding assembly has a pin movable to a first position to engage the support to retain the body in the first position and movable from the first position to a second position wherein the pin is spaced from the support, means operatively connected to the pin to selectively move the pin to its first position and second position, the means operatively connected to the pin includes a linear to rotational motion transfer mechanism having a manually-movable push rod operable to move the pin between the first and second positions.

10. A knob for a kitchen range having a control device mounted on a support, the control device having a shaft extended through a hole in the support which is linearly moved between lock and release positions and rotatable when in the release position to actuate the control device to turn ON a burner of the range comprising: a body adapted to be mounted on the shaft and used to linearly move the shaft adjacent the support opposite the control device between lock and release positions and rotate the shaft when it is in the release position to actuate the control device, and a releasable holding assembly secured to the body and cooperating with the support for selectively retaining the body in the first position to prevent operation of the control device and allowing the body to be moved to the second position whereby the control device can be actuated by pushing and turning the shaft, the releasable holding device includes a housing joined to the body, a pin engageable with the support to prevent the knob from being moved toward the support, a sleeve mounted on the housing engageable with the pin to selectively hold the pin in engagement with the support and release the pin from the support, spring means for biasing the pin away from the support, and means for linearly and angularly moving the sleeve to a first position wherein the sleeve holds the pin in engagement with the support and a second position wherein the sleeve is released from the support.

11. The know of claim 10 wherein: the means for linearly and angularly moving the sleeve includes a linear to rotational motion transfer mechanism having a manually-movable push rod operable to move the pin between the first and second positions.

12. The knob of claim 5 wherein: the means for linearly and angularly moving the sleeve includes a linear to rotational motion transfer mechanism having a manually-movable push rod operable to move the pin between the first and second position.

* * * * *